US011008765B2

(12) United States Patent
Johnson et al.

(10) Patent No.: US 11,008,765 B2
(45) Date of Patent: May 18, 2021

(54) SELF-STRIPPING CORNER FORM

(71) Applicant: Wilian Holding Co., Des Moines, IA (US)

(72) Inventors: James Johnson, Clive, IA (US); Thomas Waldschmitt, Ankeny, IA (US); Andrew Gray, Ankeny, IA (US); Robert McCracken, Urbandale, IA (US)

(73) Assignee: Wilian Holding Co., Des Moines, IA (US)

( * ) Notice: Subject to any disclaimer, the term of this patent is extended or adjusted under 35 U.S.C. 154(b) by 0 days.

(21) Appl. No.: 16/443,235

(22) Filed: Jun. 17, 2019

(65) Prior Publication Data

US 2019/0383044 A1 Dec. 19, 2019

Related U.S. Application Data

(60) Provisional application No. 62/685,414, filed on Jun. 15, 2018.

(51) Int. Cl.
*E04G 11/08* (2006.01)
*E04G 13/02* (2006.01)
(Continued)

(52) U.S. Cl.
CPC ..... *E04G 11/082* (2013.01); *E04G 13/00* (2013.01); *E04G 13/02* (2013.01); *E04G 17/001* (2013.01)

(58) Field of Classification Search
CPC ..... E04G 11/082; E04G 13/02; E04G 17/001
(Continued)

(56) References Cited

U.S. PATENT DOCUMENTS 4,424,951 A * 1/1984 Spencer ..... E04G 13/021 249/162
4,447,035 A * 5/1984 Ivey ..... B28B 7/30 249/180
(Continued)

FOREIGN PATENT DOCUMENTS

CA 2781450 A1 * 6/2011 ..... B28B 7/30
CH 551553 * 7/1974 ..... E04G 11/082
(Continued)

OTHER PUBLICATIONS

Acro Formwork: Acrowall 80 Stripping Corner: YouTube video (https://www.youtube.com/watch?v=fgyh7vKZkd4); May 1, 2015 (Year: 2015).*
(Continued)

*Primary Examiner* — Michael Safavi
(74) *Attorney, Agent, or Firm* — Dentons Davis Brown, P.C.; Sean D. Solberg

(57) ABSTRACT

A corner form apparatus having a rigid, angled form with a pair of leg sections and a plurality of gussets extending between the leg sections. A post is mounted for axial sliding back-and-forth movement within openings formed in the gussets between a pour position and a stripped position. A linear actuator is mounted between the rigid, angled form and the post and a pair of extension mounting arms are pivotally attached to the post at a first end and pivotally attached to each to an associated form extension using slotted holes at a second end whereupon movement of the post between the pour position and the stripping position moves each of the form extensions from a position coplanar with a corresponding one of the rigid, angled form leg sections in the pour position inwardly to a stripped position.

16 Claims, 10 Drawing Sheets

(51) Int. Cl.
*E04G 13/00* (2006.01)
*E04G 17/00* (2006.01)

(58) Field of Classification Search
USPC ..... 249/48, 51
See application file for complete search history.

(56) References Cited

U.S. PATENT DOCUMENTS

| | | | | |
|---|---|---|---|---|
| 4,570,896 | A * | 2/1986 | Strickland | E04G 11/082 249/152 |
| 4,666,643 | A * | 5/1987 | Spencer | E04G 13/021 264/31 |
| 5,230,907 | A | 7/1993 | Strickland | |
| 6,105,924 | A * | 8/2000 | Carr | B28B 7/30 249/152 |
| 8,020,271 | B2 | 9/2011 | Baum et al. | |
| 8,733,727 | B2 | 5/2014 | Vanagan | |
| 9,611,663 | B2 | 4/2017 | Baum | |
| 2002/0116888 | A1 | 8/2002 | Jorn et al. | |
| 2018/0313098 | A1 | 11/2018 | Baum | |

FOREIGN PATENT DOCUMENTS

| | | | | |
|---|---|---|---|---|
| DE | 2200152 | A1 * | 7/1973 | E04G 11/082 |
| DE | 102009055690 | * | 5/2011 | B28B 7/30 |
| DE | 102017222868 | A1 * | 6/2019 | E04G 17/042 |
| FR | 1436683 | A * | 4/1966 | E04G 11/082 |
| FR | 2036750 | A1 * | 12/1970 | E04G 15/065 |
| WO | 2008138763 | A1 | 11/2008 | |
| WO | 2011063922 | A1 | 6/2011 | |

OTHER PUBLICATIONS

Doka USA: Strip. Hydraulically—Hydraulic Stripping Corner: YouTube video (https://www.youtube.com/watch?v=YDJRzHAE-Vo); Jan. 31, 2017 (Year: 2017).*

Acrow Formwork, "Acrowall 80 stripping corner-hydraulic version", "YouTube", May 1, 2015.

* cited by examiner

SELF-STRIPPING CORNER FORM

CROSS-REFERENCE TO RELATED APPLICATION(S)

This application claims the benefit under 35 U.S.C. § 119(e) to U.S. Provisional Application 62/685,414, filed Jun. 15, 2018 and entitled "Self-Stripping Corner Form," which is hereby incorporated herein by reference in its entirety.

FIELD OF THE INVENTION

The various embodiments herein relate generally to apparatuses used in forming concrete structures and, more specifically, to a concrete forming apparatus for use in forming corners of a concrete structure.

BACKGROUND OF THE INVENTION

Various concrete forming devices and systems are in wide use in the construction of buildings, bridges, and other concrete structures. A common system for forming concrete structures uses a plurality of form components that are adapted to be assembled into a wide variety of configurations to conform to virtually any dimensional requirement. Such forming apparatus components are typically made of metal so that they are strong enough to support the lateral pressure of poured concrete and durable so that the components can be reused many times.

One of the configurations that is most frequently encountered in constructing concrete structures is the right angle corner. To form a concrete wall having a corner, two sets of forms must be constructed, an inside corner form and a corresponding outside corner form that is spaced from the inside corner form by the thickness of the wall to be formed between the two forms. Once the concrete has been poured and has set sufficiently, the forms must be stripped (removed) from the wall. This typically does not present a problem on the outside corner form where there is sufficient room to separate the form components and release them from the wall. On the inside corner form, however, the form components frequently are difficult to disassemble and release from the wall because of the inside corner geometry and because of the pressure that is exerted on the inside forms by the poured concrete.

Since it has become common to have hydraulic power systems at concrete construction sites, it is advantageous to have the ability to use hydraulically actuated cylinders to set and strip forming system components.

There is a need in the art for an improved corner form for forming concrete corners that can be actuated to strip the form from the corner after the concrete has set.

BRIEF SUMMARY OF THE INVENTION

Discussed herein are various embodiments of a self-stripping corner form that has an actuation component that can be actuated to remove the form from the set concrete.

The various implementations herein consist of a double bias form component used in forming a corner of a concrete structure. The component consists of a rigid, angled form member having a pair of leg sections extended at a predetermined angle, such as a right angle. Each of the leg components has a form extension that is movable between a pour position wherein it is co-planar with its associated leg section and a stripped position wherein it has been moved inside of the rigid, angled form member.

A post is mounted for axial movement upwardly and downwardly relative to the rigid, angled member inside a plurality of gussets of the rigid, angled member. A linear actuator extends between a mounting point on the rigid, angled form member and mounting bracket affixed to the post. The post also carries one or more plates. A pair of arms are pivotally mounted at a first end to the plates and are also pivotally attached at the opposite, second end to a corresponding one of the form extensions. Accordingly, extension and retraction of the actuator moves the post in opposing directions and results in movement of the form extensions between the pour position and the stripped position.

An object of the present invention is to provide a form apparatus for forming corners of a concrete structure that can be integrated with conventional wall form components.

Another object of the invention is to provide a form apparatus for forming corners of a concrete structure which can be easily and readily stripped from the formed wall using motive power such as, for example, hydraulic power.

These and other objects of the invention will be made apparent to those skilled in the art upon a review and understanding of this specification, the associated drawings, and the appended claims.

In Example 1, a corner form apparatus comprises a rigid, angled form having a pair of leg sections and a plurality of gussets extending between the leg sections, a post mounted for axial sliding back-and-forth movement within openings formed in the gussets between a pour position and a strip position, a linear actuator mounted between the rigid, angled form and the post, and a pair of extension mounting arms, each pivotally attached to the post at a first end and pivotally attached to an associated slidable form extension using slotted holes at an outer, second end, whereupon movement of the post between the pour position and the stripping position moves each of the form extensions from a position coplanar with a corresponding one of the rigid, angled form leg sections in the pour position inwardly to a strip position.

Example 2 relates to the corner form apparatus according to Example 1, wherein a first of the pair of leg sections comprises a first form outer surface, a second of the pair of leg sections comprises a second form outer surface, a first of the slidable form extensions comprises a first extension outer surface, and a second of the slidable form extensions comprises a second extension outer surface.

Example 3 relates to the corner form apparatus according to Example 2, wherein, in the pour position, the first extension outer surface is coplanar with the first form outer surface and the second extension outer surface is coplanar with the second form outer surface.

Example 4 relates to the corner form apparatus according to Example 2, wherein, in the strip position, the first extension outer surface is not coplanar with the first form outer surface and the second extension outer surface is not coplanar with the second form outer surface.

Example 5 relates to the corner form apparatus according to Example 1, wherein, in the pour position, the second end of each of the pair of extension arms is disposed at an outermost position in the slotted holes.

Example 6 relates to the corner form apparatus according to Example 1, wherein, in the strip position, the second end of each of the pair of extension arms is disposed at an innermost position in the slotted holes.

Example 7 relates to the corner form apparatus according to Example 1, wherein, in the pour position, the linear actuator is disposed in an extended position, and further wherein, in the strip position, the linear actuator is disposed in a retracted position.

In Example 8, a corner form apparatus comprises a body comprising a first leg, a second leg attached to the first leg such that the body has a generally triangular cross-section, and at least two gussets disposed between and coupled to the first and second legs. The corner form apparatus further comprises a post slidably coupled to the body such that the post is slidable along an axis parallel to a longitudinal axis of the body between a first position and a second position, a linear actuator operably coupled to the body and the post, wherein the linear actuator is movable between a first actuator position corresponding with the first position of the post and a second actuator position corresponding with the second position of the post, a first movable wing movably coupled to the first leg, a second movable wing movably coupled to the second leg, wherein each of the first and second movable wings are movable between an extended position corresponding to the first actuator position and a retracted position corresponding to the second actuator position, and at least a first set of pivot arms, wherein the first pivot arm is pivotably coupled at a first end to the post and is pivotably coupled at a second end to the first movable wing, and wherein the second pivot arm is pivotably coupled at a first end to the post and is pivotably coupled at a second end to the second movable wing, wherein the first set of pivot arms are movable between an extended position corresponding to the first actuator position and a retracted position corresponding to the second actuator position.

Example 9 relates to the corner form apparatus according to Example 8, wherein the post is slidably disposed through openings defined in the at least two gussets.

Example 10 relates to the corner form apparatus according to Example 8, wherein the second end of the first pivot arm is slidably disposed within a first elongate opening defined within the first leg and the second end of the second pivot arm is slidably disposed within a second elongate opening defined within the second leg.

Example 11 relates to the corner form apparatus according to Example 10, wherein the second end of the first pivot arm comprises a first pin disposed within the first elongate opening and the second end of the second pivot arm comprises a second pin disposed within the second elongate opening.

Example 12 relates to the corner form apparatus according to Example 11, wherein the first pin is fixedly coupled to the first movable wing and the second pin is fixedly coupled to the second movable wing.

Example 13 relates to the corner form apparatus according to Example 8, further comprising a first form outer surface disposed on an outer portion of the first leg, a second form outer surface disposed on an outer portion of the second leg, a first wing outer surface disposed on an outer portion of the first wing, and a second wing outer surface disposed on an outer portion of the second wing.

Example 14 relates to the corner form apparatus according to Example 13, wherein, when the first and second wings are in the extended position, the first wing outer surface is coplanar with the first form outer surface and the second wing outer surface is coplanar with the second form outer surface.

Example 15 relates to the corner form apparatus according to Example 13, wherein, when the first and second wings are in the retracted position, the first wing outer surface is not coplanar with the first form outer surface and the second wing outer surface is not coplanar with the second form outer surface.

Example 16 relates to the corner form apparatus according to Example 8, wherein the first actuator position is an extended actuator position and the second actuator position is a retracted actuator position.

In Example 17, a method of forming a corner of a concrete structure comprises attaching a corner form apparatus to adjacent concrete form panels, the corner form apparatus comprising a rigid, angled body having a pair of leg sections and at least two gussets extending between the leg sections, a slidable post disposed within openings formed in the gussets such that the post is slidable along an axis parallel to a longitudinal axis of the body, a linear actuator mounted between the rigid, angled body and the post, a pair of extendable wings movably coupled to the pair of leg sections, wherein a first of the pair of wings is movably coupled to a first of the pair of leg sections and a second of the pair of wings is movably coupled to a second of the pair of leg sections, and a pair of pivot arms, wherein the first pivot arm is pivotably coupled at a first end to the post and is pivotably coupled at a second end to the first extendable wing, and wherein the second pivot arm is pivotably coupled at a first end to the post and is pivotably coupled at a second end to the second extendable wing. The method further comprises configuring the corner form apparatus in a pour position, wherein the pair of pivot arms is disposed in an extended pivot arm position such that the pair of extendable wings are disposed in an extended wing position, pouring concrete adjacent to the corner form apparatus, allowing the concrete to cure, actuating the linear actuator to move from a first position to a second position, whereby the slidable post slides from a first position to a second position, whereby the pair of pivot arms move from the extended pivot arm position to a retracted pivot arm position, whereby the pair of extendable wings move from the extended wing position to a retracted wing position, and removing the corner form apparatus from the concrete.

Example 18 relates to the method according to Example 17, wherein, when the pair of extendable wings are in the extended wing position, a first outer surface of a first wing of the pair of extendable wings is coplanar with a first outer surface of the first leg section and a second outer surface of a second wing of the pair of extendable wings is coplanar with a second outer surface of the second leg section.

Example 19 relates to the method according to Example 17, wherein, when the pair of extendable wings are in the retracted wing position, a first outer surface of a first wing of the pair of extendable wings is not coplanar with a first outer surface of the first leg section and a second outer surface of a second wing of the pair of extendable wings is not coplanar with a second outer surface of the second leg section, wherein the retracted wing position facilitates removal of the corner form apparatus from the concrete.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

The various implementations disclosed or contemplated herein relate to a corner form assembly having a linear actuator that actuates form extensions to move between an extended position in which the form can be used to pour concrete and a retracted position that facilitates removal of the form assembly from the cured concrete.

Figure 1A:
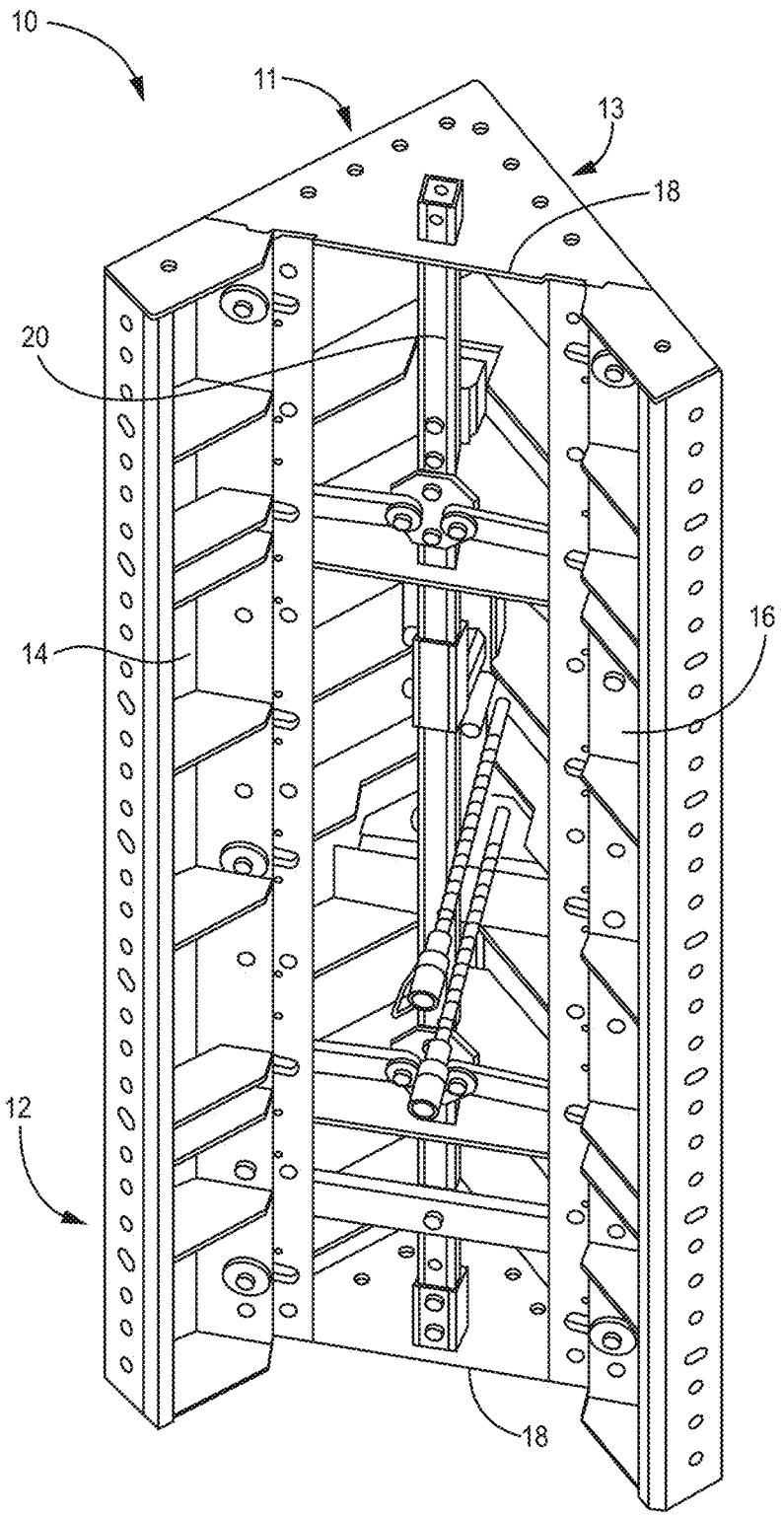
FIG. 1A is a perspective view of the rear side of a hydraulic corner form assembly, according to one embodiment.
Figure 1B:
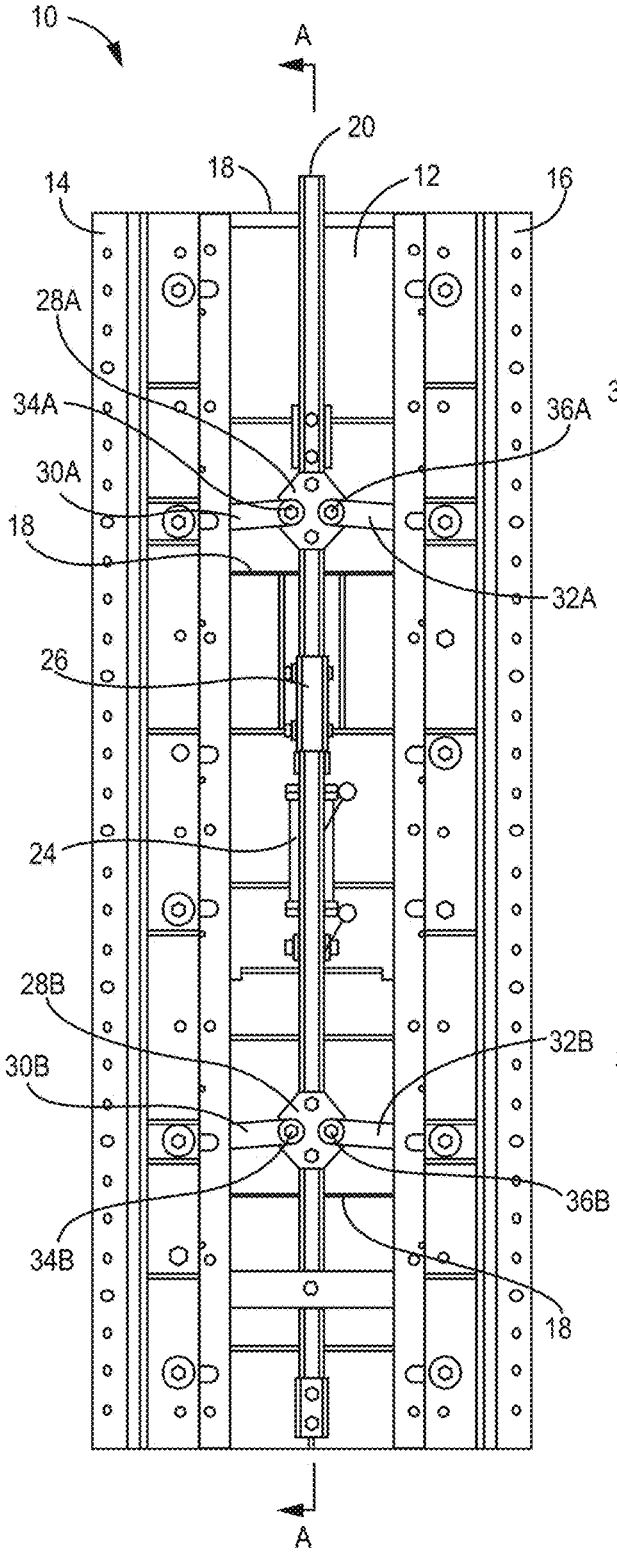
FIG. 1B is a back view of the corner form assembly of FIG. 1A in the pour configuration, according to one embodiment.
Figure 1C:
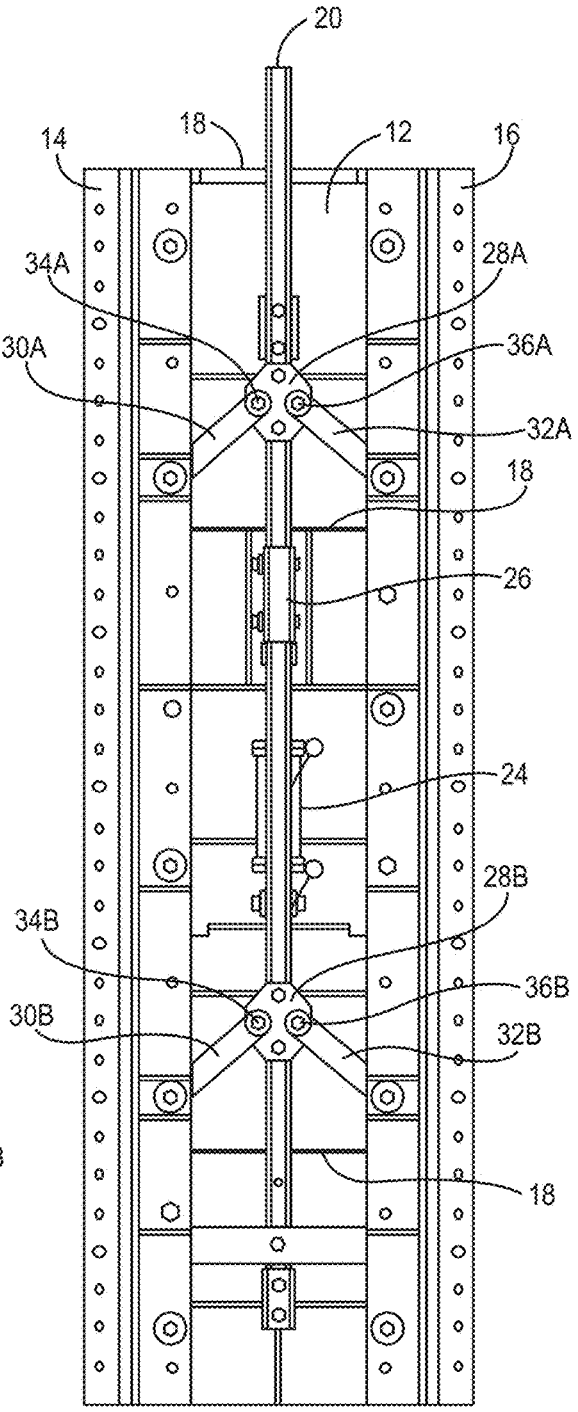
FIG. 1C is another back view of the corner form assembly of FIG. 1A in the strip configuration, according to one embodiment.
Figure 1D:
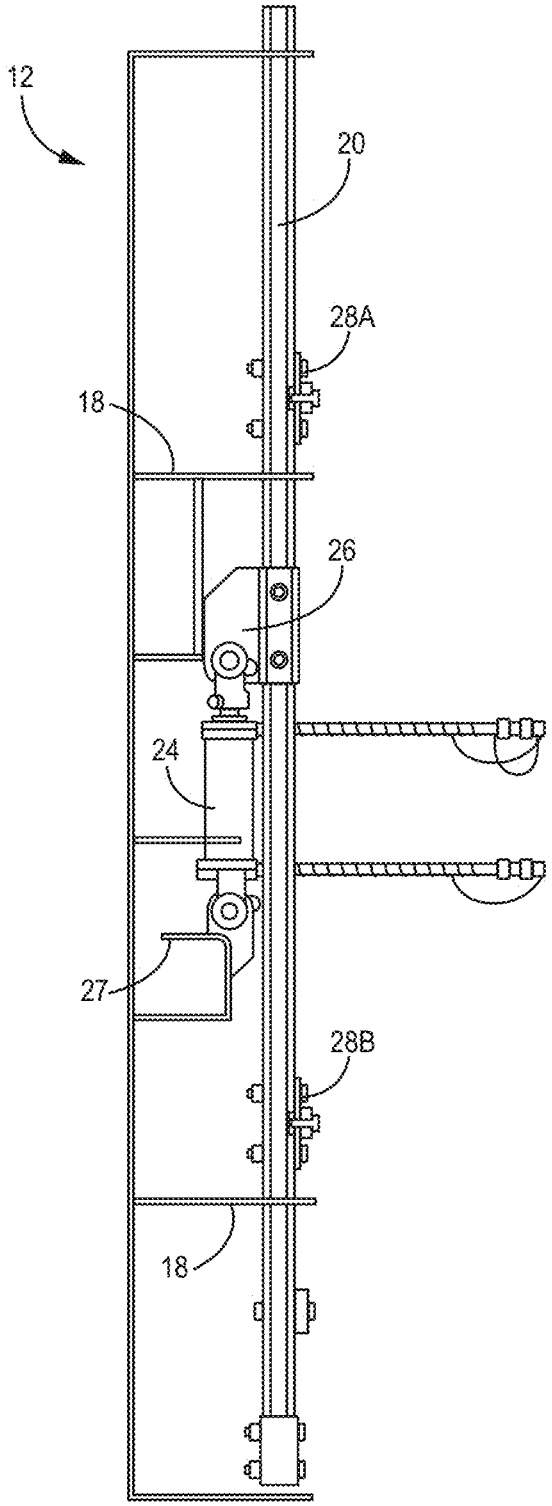
FIG. 1D is a cross-sectional side view of the corner form assembly taken along line A-A of FIG. 1B, according to one embodiment.
Figure 1E:
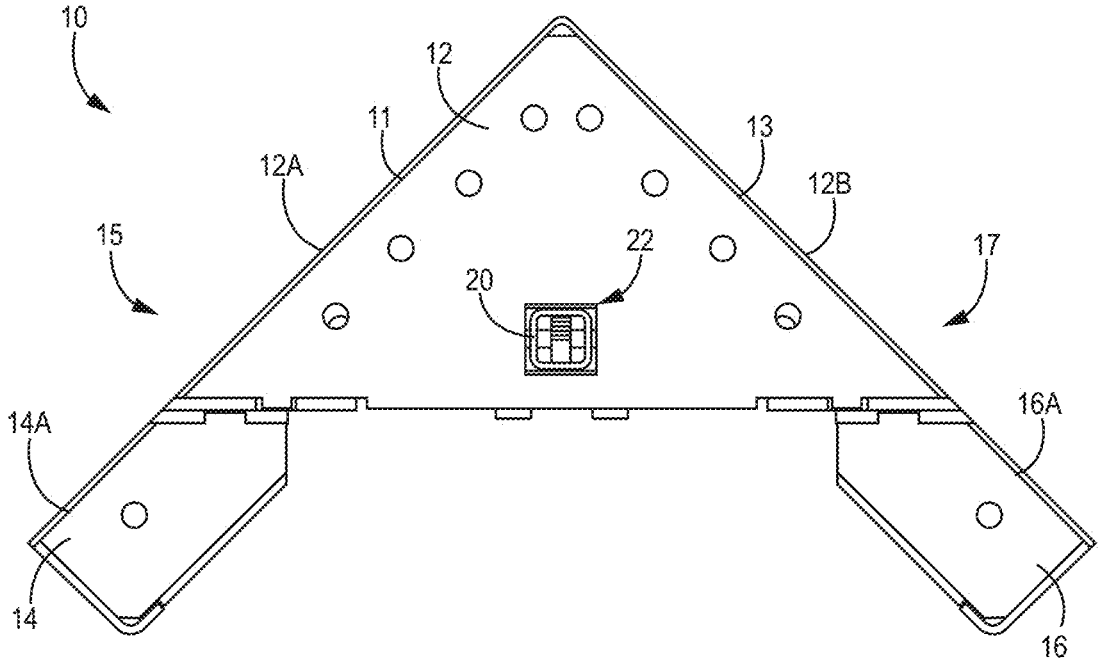
FIG. 1E is a top view of the corner form assembly of FIG. 1A in the pour configuration, according to one embodiment.
Figure 1F:
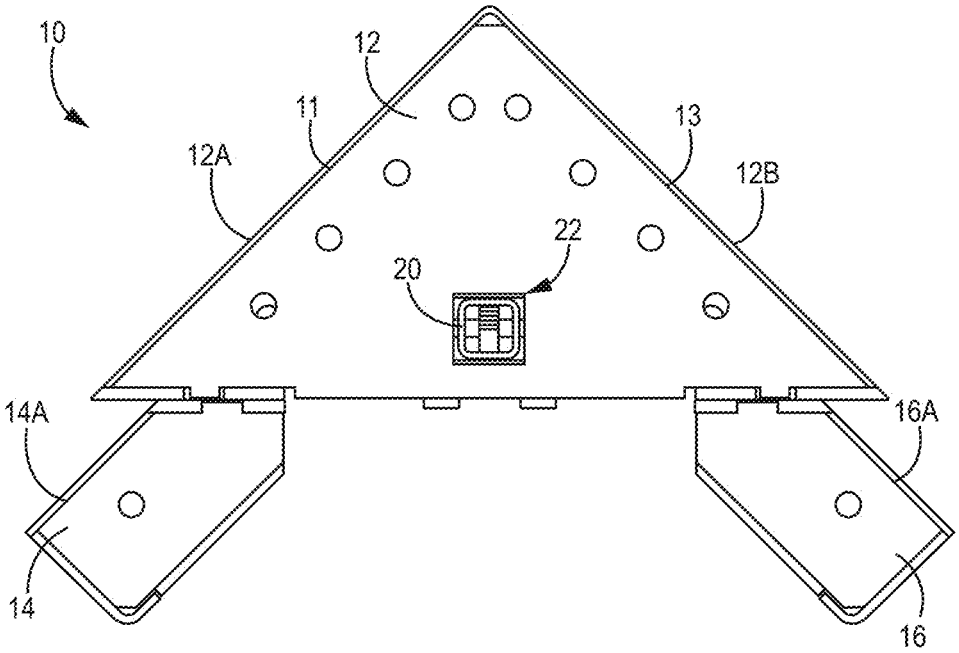
FIG. 1F is a top view of the corner form assembly of FIG. 1A in the strip configuration, according to one embodiment.

One exemplary corner form assembly 10 according to one embodiment is depicted in FIGS. 1A-1E. The assembly 10 has a rigid, angled form body 12 with two legs 11, 13 having two form wings or panels (also referred to as "extensions") 14, 16 slidably coupled thereto. More specifically, as best shown in FIGS. 1E and 1F (which are top views of the assembly 10), the body 12 has a generally triangular cross-section when viewed from above, with the two legs 11, 13 being coupled together to form that triangular shape, and slidable wing 14 is slidably attached to leg 11, while slidable wing 16 is slidably attached to leg 13. The body 12 has two outer surfaces 12A, 12B, with outer surface 12A being the outer surface of leg 11 and outer surface 12B being the outer surface of leg 13, and the slidable wings 14, 16 have outer surfaces 14A, 16A. The first outer surface 12A and the outer surface 14A of the first wing 14 form a first face sheet 15, and the second outer surface 12B and the outer surface 16A of the second wing 16 form a second face sheet 17. The first and second face sheets 15, 17 are the contact surfaces 15, 17 that are in contact with the concrete when it is poured. As a result, it is understood in the industry that the face sheets 15, 17 are the "front" of the assembly 10 and thus will be considered as such for purposes of the figures herein. In addition, the body 12 has at least two triangular gussets (also referred to as "supports") 18 that attach to both legs 11, 13 of the body 12 to maintain or enhance the rigidity thereof.

In addition, the body 12 also has an actuation assembly. As best shown in FIGS. 1B-1D, the actuation assembly includes the linear actuator 24, which is operably coupled to a slidable post 20 via an actuator mounting bracket 26, and two sets of pivot arms 30A, 32A, 30B, 32B pivotably coupled to the post 20. More specifically, the actuator 24 is fixedly coupled to the slidable post 20 via the bracket 26 at one end, and further is fixedly attached at the other end to form body 12. In this specific implementation, the actuator 24 is fixedly attached to the form body 12 via a bracket 27. Alternatively, the actuator 24 can be fixedly attached to the form body 12 via any component or in any known fashion. As best shown in FIGS. 1E and 1F, the slidable post 20 is slidably disposed through openings 22 defined in the gussets 18 such that the post 20 can move back and forth in a linear fashion in a direction that is parallel to the longitudinal axis of the post 20. Thus, actuation of the actuator 24 causes movement of the post 20 within the openings 22. More specifically, extension of the actuator 24 causes the slidable post 20 to move in the same direction as the actuator 24, and retraction of the actuator causes the slidable post 20 to move in the opposing direction.

According to one embodiment, as mentioned above, the slidable post 20 has two sets of pivot arms 30A, 32A, 30B, 32B pivotably attached at one end to the post 20. More specifically, in this implementation, the first (or upper) set of pivot arms 30A, 32A is pivotably coupled to a first mounting plate 28A that is fixedly attached to the post 20, and the second (or lower) set of pivot arms 30B, 32B is pivotably coupled to a second mounting plate 28B that is fixedly attached to the post 20. The pivot arm 30A is coupled via a pivotal joint 34A to the first mounting plate 28A, and the pivot arm 32A is coupled via a pivotal joint 36A to the first mounting plate 28A. Similarly, the pivot arm 30B is coupled via a pivotal joint 34B to the second mounting plate 28B, and the pivot arm 32B is coupled via a pivotal joint 36B to the second mounting plate 28B. It is understood that the pivotal joints 34A, 34B, 36A, 36B according to one embodiment, are bolt and bushing combinations. Alternatively, the pivotal joints 34A, 34B, 36A, 36B can be any known pivotal joints for use in concrete form assemblies. Further, it is understood that the number of pivot arm sets can vary from one set to any number of sets required, depending on the size of the body 12.

At the other end, the pivot arms 30A, 32A, 30B, 32B are slidably coupled to the body 12 and fixedly coupled to the wings 14, 16 such that actuation of the post 20 and the resulting actuation of the pivot arms 30A, 32A, 30B, 32B causes movement of the wings 14, 16 (as best shown in FIGS. 1E and 1F), thereby facilitating removal of the body 12 from cured concrete. For ease of depiction and description of the pivot arms 30, 32 and how they operate to move the wings 14, 16, FIGS. 2A-3B show an expanded view of one exemplary set of pivot arms 30, 32 that are intended to represent both sets of pivot arms 30A, 32A, 30B, 32B of FIGS. 1A-1C. As shown, the ends of the pivot arms 30, 32 opposite the post 20 are slidably coupled to the body 12 and fixedly coupled to the wings 14, 16 via slidable joints 42, 44 slidably disposed within slots 38, 40 defined in the body 12. More specifically, the slidable joints 42, 44 are fixedly coupled to the wings 14, 16. Thus, movement of the post 20 causes movement of the pivot arms 30, 32, causing movement of the wings 14, 16, as shown in FIGS. 1E, 1F, 2B, and 3B.

In one embodiment, the slidable joints 42, 44 are bolt and bushing combinations 42, 44 slidably disposed within the slots 38, 40. Alternatively, the slidable joints 42, 44 can be slidable pins 42, 44 disposed within the slots 38, 40. In a further embodiment, the slidable coupling of the pivot arms 30, 32 to the body 12 and fixed coupling to the wings 14, 16 can be any known coupling.

Figure 2A:
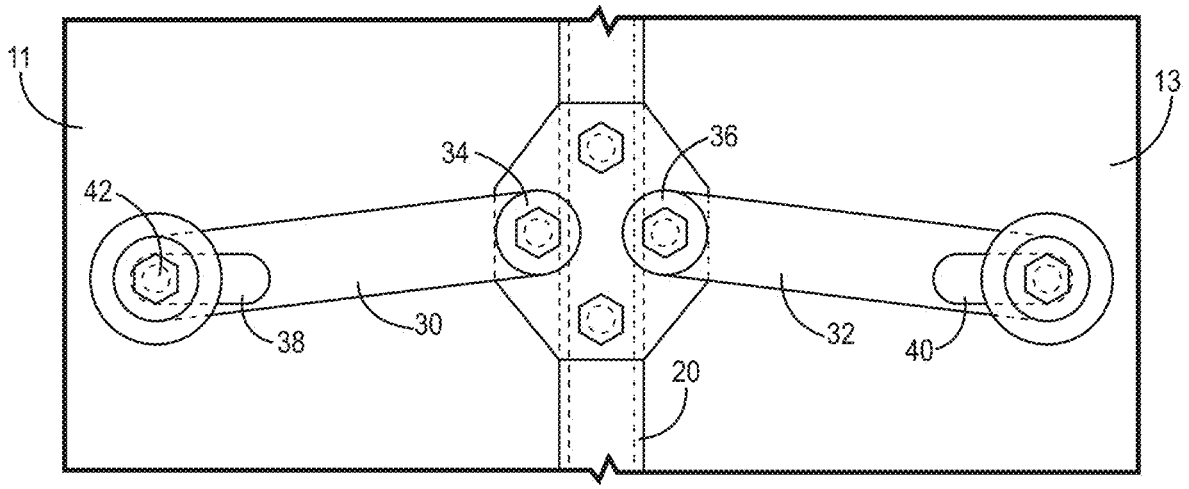
FIG. 2A is an expanded back view of a set of pivot arms coupled to the assembly wings of a corner form assembly disposed in the pour position, according to one embodiment.
Figure 2B:
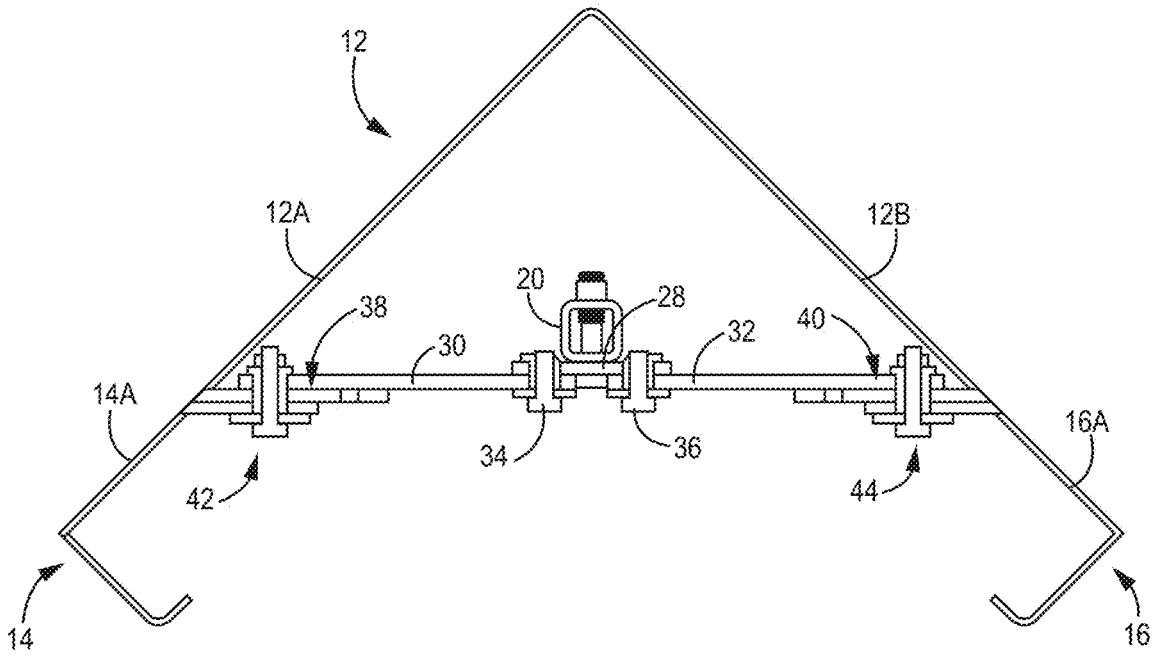
FIG. 2B is an expanded top view of the set of pivot arms coupled to the assembly wings of the corner form assembly of FIG. 2A disposed in the pour position, according to one embodiment.
Figure 3A:
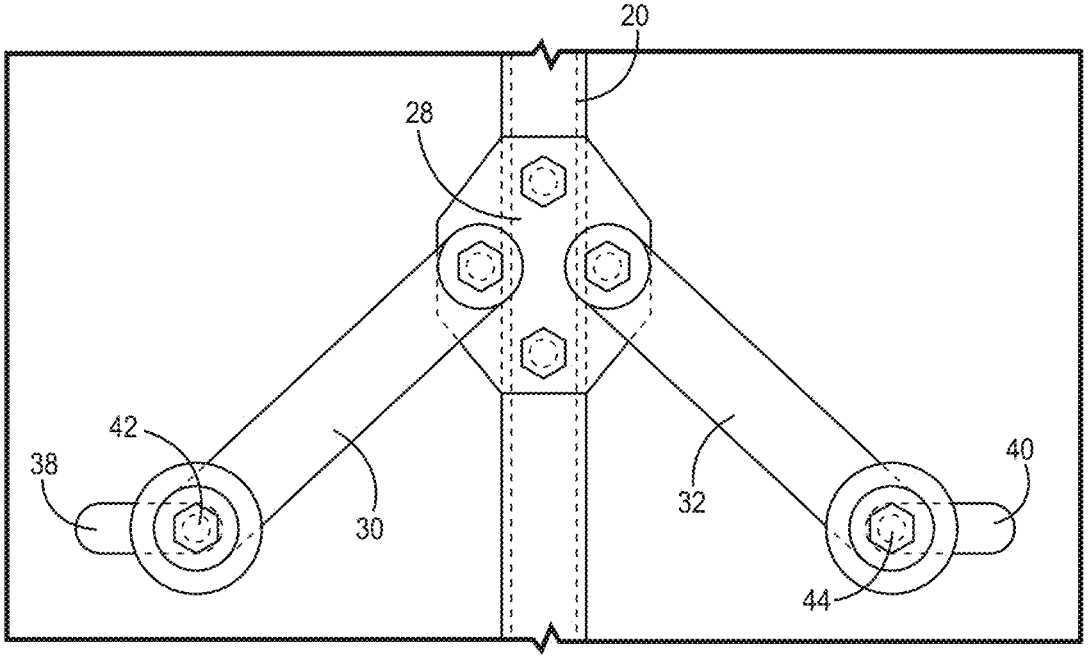
FIG. 3A is an expanded back view of the set of pivot arms coupled to the assembly wings of the corner form assembly of FIG. 2A disposed in the strip position, according to one embodiment.
Figure 3B:
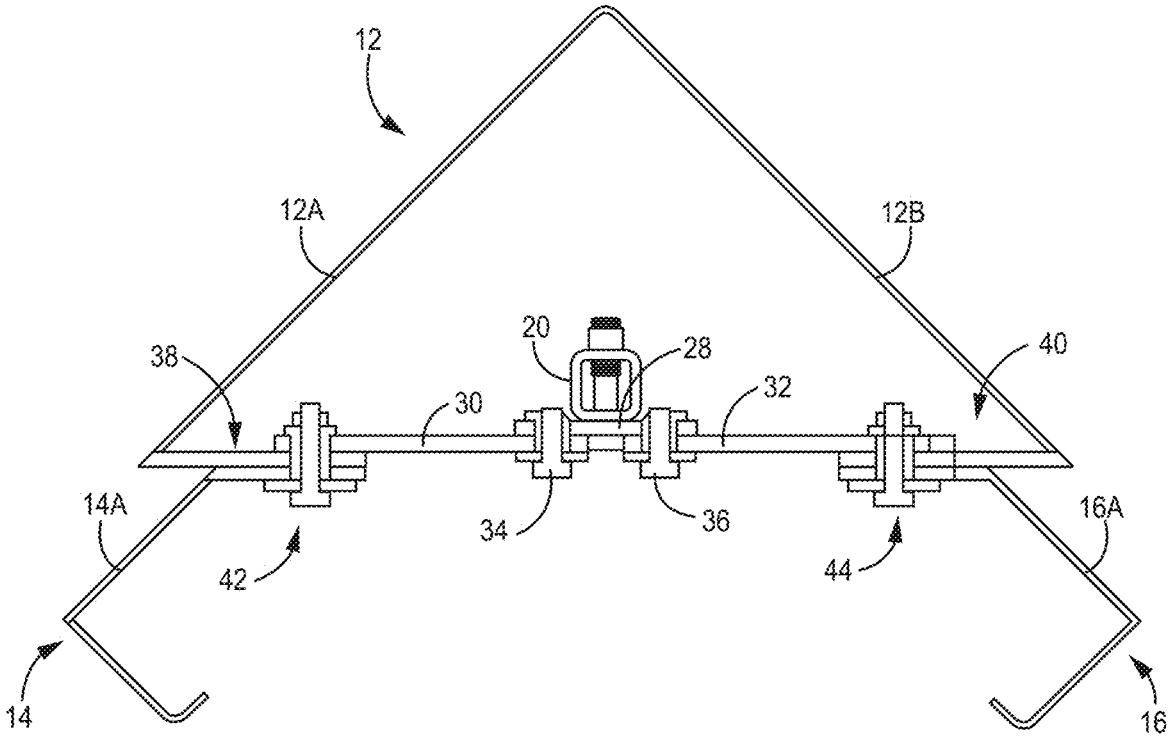
FIG. 3B is an expanded top view of the set of pivot arms coupled to the assembly wings of the corner form assembly of FIG. 3A disposed in the strip position, according to one embodiment.

Thus, the post 20 (and thus the pivot arms 30, 32 and thus the wings 14, 16) moves between a deployed (or "pour") position as shown in FIGS. 2A and 2B (along with FIG. 1B) and a retracted (or "strip") position as shown in FIGS. 3A and 3B (along with FIG. 1C). The deployed position as shown in FIGS. 2A and 2B in which the outer surfaces 14A, 16A, of the wings 14, 16 are aligned (or "flush") with the outer surfaces 12A, 12B of the body 12 is also called the pour position because it's the configuration in which the form assembly 10 is in the appropriate configuration to pour concrete, as best shown in FIGS. 1E and 2B. In contrast, the retracted position as shown in FIGS. 3A and 3B in which the wings 14, 16 are retracted and thus not flush with the outer surfaces 12A, 12B is also called the strip position because it's the configuration in which the wings 14, 16 have been retracted, thereby facilitating the removal (or "stripping") of the form assembly 10 from the poured concrete, as best shown in FIGS. 1F and 3B.

In use, when the assembly 10 is being prepared to be coupled to adjacent form panels (not shown) to pour a corner of a concrete structure, the actuator 24 is actuated to retract the post 20 to the position depicted in FIGS. 2A and 2B (and also shown in FIG. 1B), thereby causing the pivot arms 30, 32 to urge the slidable joints 42, 44 outward to the outermost position in the slots 38, 40, thereby positioning the wings 14, 16 such that the outer surfaces 14A, 16A are flush with the outer surfaces 12A, 12B of the body 12. Once the concrete has been poured and has been allowed to set, the assembly 10 can be removed. At this point, the actuator 24 is actuated to extend the post 24 to the position depicted in FIGS. 3A and 3B (and also FIG. 1C), thereby causing the pivot arms 30, 32 to urge the slidable joints 42, 44 inward to the innermost position in the slots 38, 40, thereby retracting the wings 14, 16 in relation to the body 12 such that the outer surfaces 14A, 16A of the wings 14, 16 are not flush with the outer surfaces 12A, 12B of the body 12, thereby facilitating removal of the assembly 10 from the concrete.

Figure 4A:
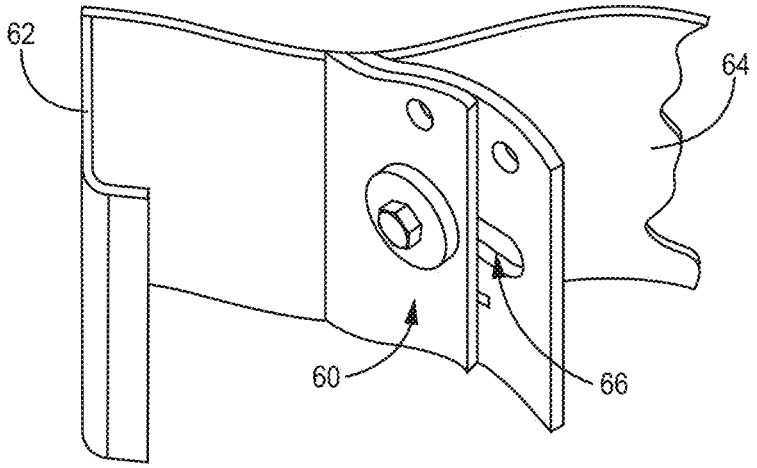
FIG. 4A is an expanded perspective view of a slidable joint of a corner form assembly disposed in the pour position, according to one embodiment.
Figure 4B:
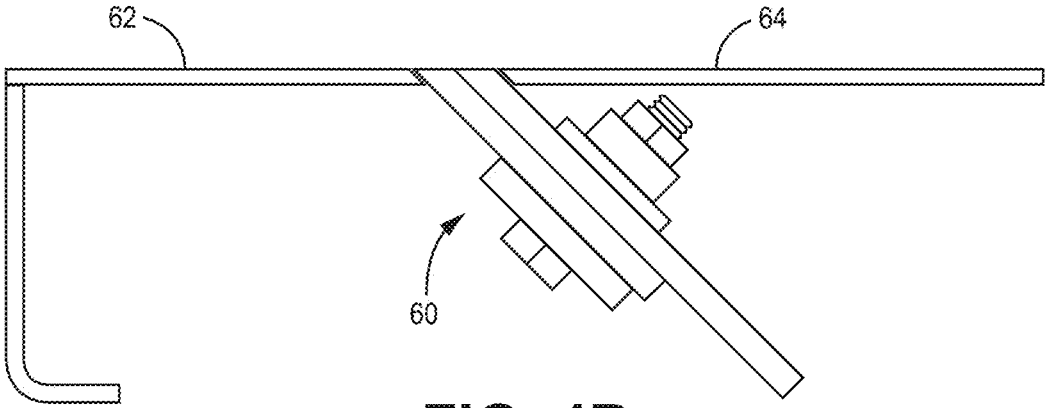
FIG. 4B is an expanded top view of the slidable joint of the corner form assembly of FIG. 4A disposed in the pour position, according to one embodiment.
Figure 4C:
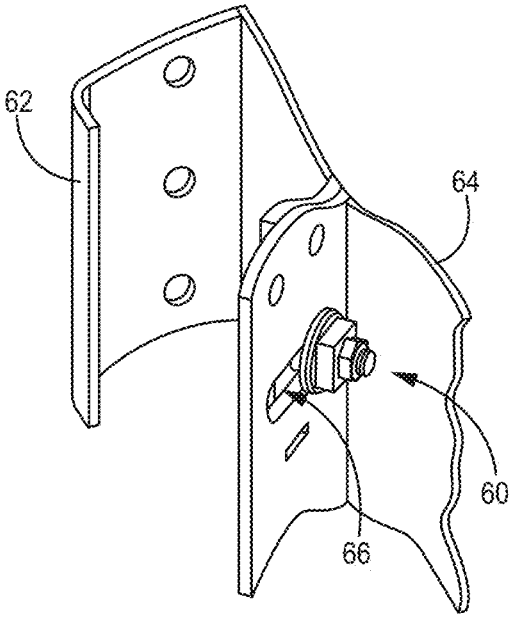
FIG. 4C is another expanded perspective view of the slidable joint of the corner form assembly of FIG. 4A disposed in the pour position, according to one embodiment.
Figure 5A:
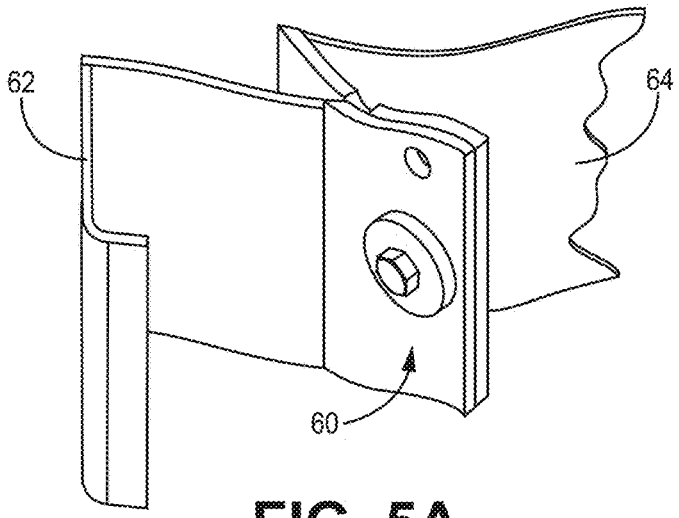
FIG. 5A is an expanded perspective view of the slidable joint of the corner form assembly of FIG. 4A disposed in the strip position, according to one embodiment.
Figure 5B:
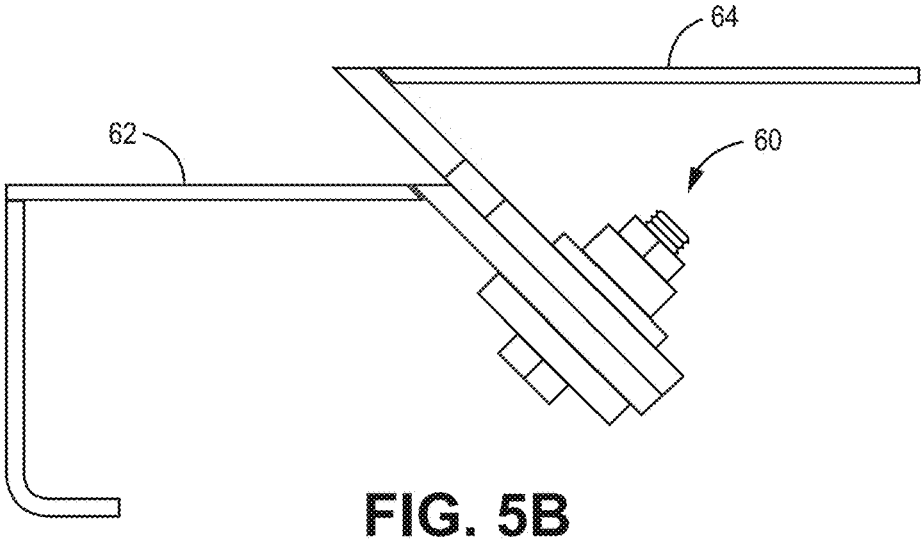
FIG. 5B is an expanded top view of the slidable joint of the corner form assembly of FIG. 5A disposed in the strip position, according to one embodiment.
Figure 5C:
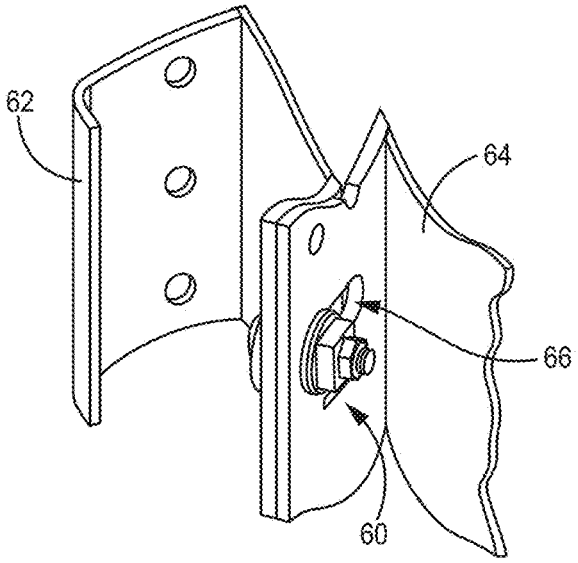
FIG. 5C is another expanded perspective view of the slidable joint of the corner form assembly of FIG. 5A disposed in the strip position, according to one embodiment.

One specific exemplary embodiment of a slidable joint 60, which could be incorporated into any of the assembly embodiments disclosed or contemplated herein, is depicted in FIGS. 4A-6C, in which the joint 60 couples the wing 62 to the body 64. FIGS. 4A-4C depict the slidable joint 60 in the pour position, in which the bolt and bushing 60 is disposed at the outermost position in the slot 66, while FIGS. 5A-5C depict the slidable joint 60 in the strip position, in which the bolt and bushing 60 is disposed at the innermost position in the slot 66. In this implementation, the body 64 has the slot 66 along which the bolt and bushing 60 can slide, while the wing 62 has a circular opening 68 configured to receive the bolt and bushing 60 in a fixed fashion. Thus, the bolt and bushing 60 is fixedly attached to the wing 62 and slidably attached to the body 64.

Figure 6A:
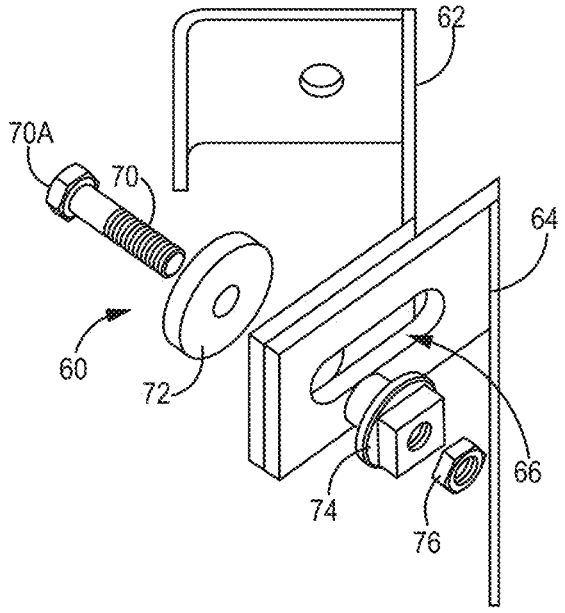
FIG. 6A is an exploded perspective view of the slidable joint of the corner form assembly of FIG. 4B, according to one embodiment.
Figure 6B:
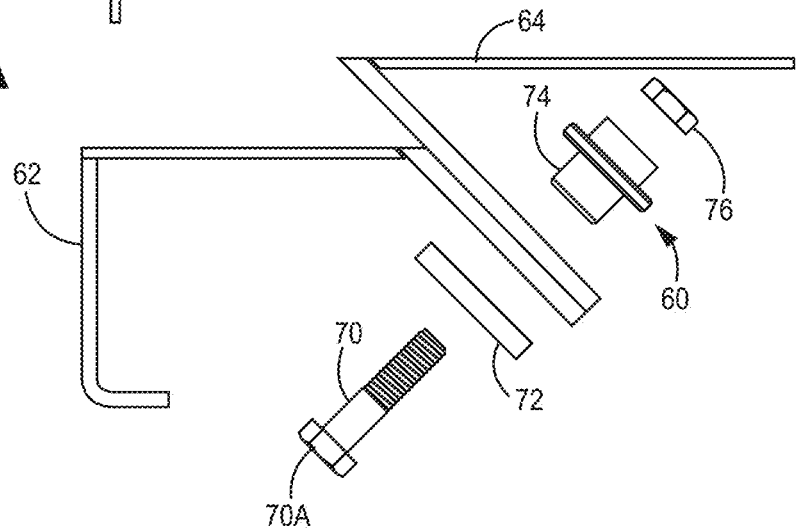
FIG. 6B is an exploded top view of the slidable joint of the corner form assembly of FIG. 6A, according to one embodiment.
Figure 6C:
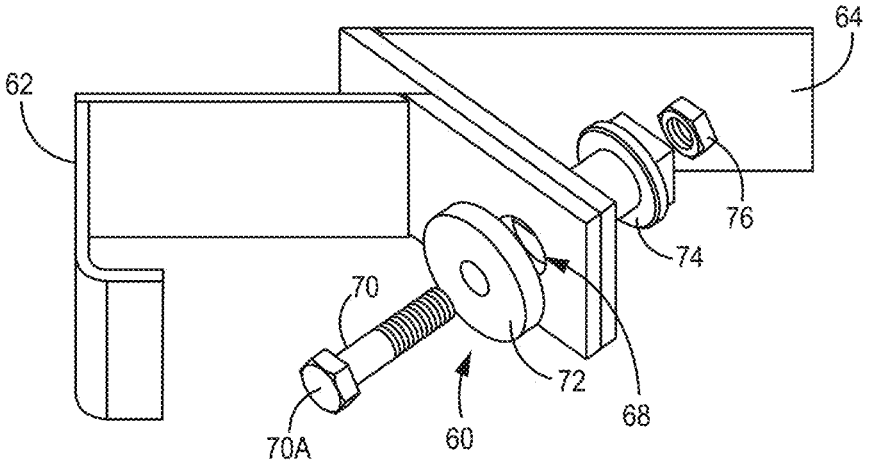
FIG. 6C is another exploded perspective view of the slidable joint of the corner form assembly of FIG. 6A, according to one embodiment.

One exemplary implementation of the bolt and bushing (or slidable pin) 60 is depicted in further detail in FIGS. 6A-6C, which show an exploded view of the various discrete components of the pin 60. More specifically, the slidable pin 60 includes a threaded bolt 70, a washer 72 disposed in contact with the head 70A of the bolt 70, a threaded, shouldered washer 74 disposed opposite the bolt head 70, and a hex nut 76. In use, this configuration makes it possible to make very precise adjustments to the tightness of the pin 60 in relation to the wing 62 and body 64. That is, the threaded, shouldered washer 74 can be threaded onto and tightened in relation to the bolt 70 with a wrench or other tool that can be coupled to the shoulder portion of the washer 74, thereby setting the tightness of the pin 60. Once the tightness is set as desired, the hex nut 76 can be threaded onto the bolt and tightened against the threaded, shouldered washer 74 to thereby lock the washer 74 in place, thereby locking the desired tightness in place. In one embodiment, the ability to make such precise adjustments to this locking pin 60 is important, because the metal pieces that make up the wing 62 and body 64 at the point where they are in contact can vary in thickness. As such, the locking pin 60 must be easily and precisely adjustable to address this variation in the metal pieces. Thus, the locking pin 60 can be precisely adjusted to ensure that the slidable joint 60 is sufficiently tight to prevent concrete from seeping through the joint, but loose enough to allow the wing 62 to slide in relation to the body 64.

Figure 7:
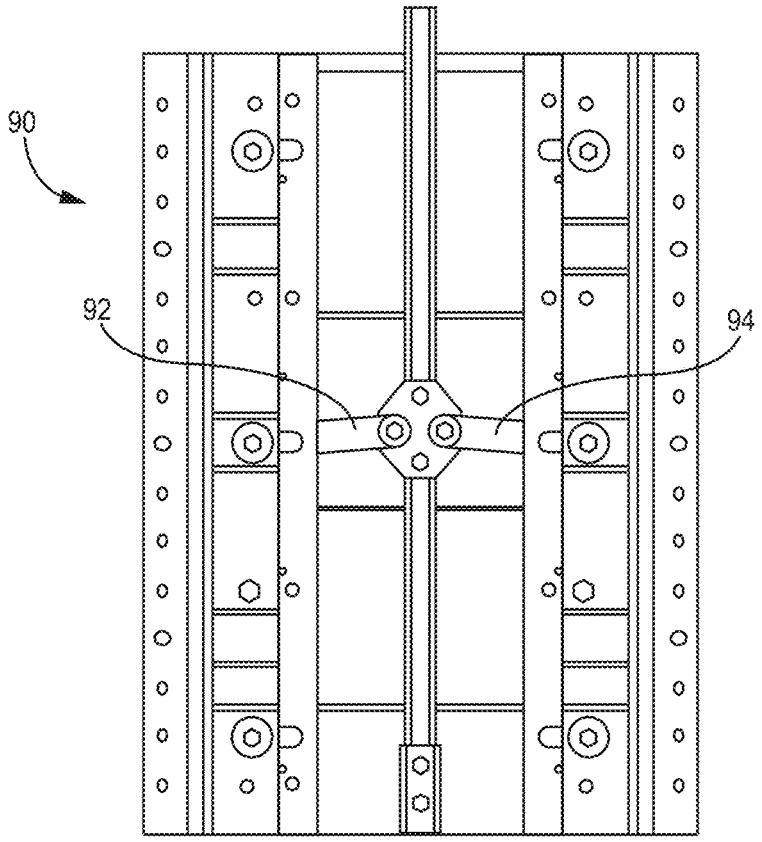
FIG. 7 is a back view of another corner form assembly, according to another embodiment.

It is understood that the corner form assembly can be constructed in any desirable size. For example, a smaller embodiment of a corner form assembly 90 is depicted in FIG. 7, in which the assembly 90 has one set of pivot arms 92, 94, instead of two or more. Alternatively, a larger assembly can have three or more sets of pivot arms. Further, while in certain implementations, the angle of the angled body is 90° (including the body 12 discussed above), it is understood that other body implementations can have other predetermined angles as necessary for any type of corner or angled feature in a concrete structure.

Figure 8:
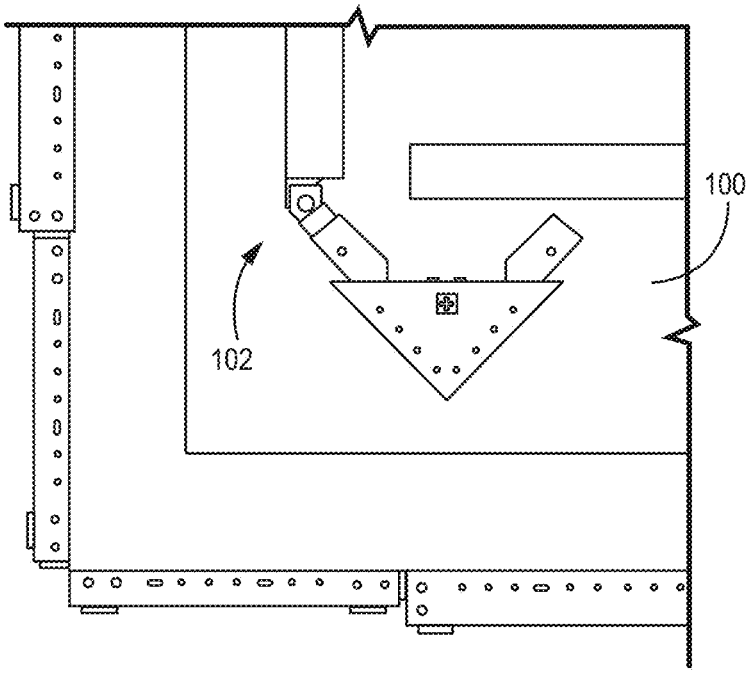
FIG. 8 is a top view of an alternative hinged mounting for a corner form assembly, according to one embodiment.

According to a further embodiment as shown in FIG. 8, a form assembly 100 according to any embodiment herein can have a hinge 102 as shown that provides for pivotal mounting of the form assembly 10, thereby providing additional stripping relief if required.

Although the present invention has been described with reference to preferred embodiments, persons skilled in the art will recognize that changes may be made in form and detail without departing from the spirit and scope of the invention.

What is claimed is:

1. A corner form apparatus, comprising:

(a) a rigid, angled form having a pair of leg sections and a plurality of gussets extending between the leg sections;

(b) a post mounted for axial sliding back-and-forth movement within openings formed in the gussets between a pour position and a strip position;

(c) a linear actuator mounted between the rigid, angled form and the post; and (d) a pair of extension mounting arms, each pivotally attached to the post at a first end and pivotally attached to an associated slidable form extension at an outer, second end, wherein each of the second ends is slidably disposed in a slotted hole defined in the rigid, angled form, wherein each slotted hole has an inner end and an outer end, whereupon movement of the post between the pour position and the stripping position moves each of the second ends from the outer end to the inner end of the slotted holes, thereby moving the form extensions from a position coplanar with a corresponding one of the rigid, angled form leg sections in the pour position inwardly to a strip position.

2. The corner form apparatus of claim 1, wherein:

a first of the pair of leg sections comprises a first form outer surface, a second of the pair of leg sections comprises a second form outer surface, a first of the slidable form extensions comprises a first extension outer surface, and a second of the slidable form extensions comprises a second extension outer surface.

3. The corner form apparatus of claim 2, wherein, in the pour position, the first extension outer surface is coplanar with the first form outer surface and the second extension outer surface is coplanar with the second form outer surface.

4. The corner form apparatus of claim 2, wherein, in the strip position, the first extension outer surface is not coplanar with the first form outer surface and the second extension outer surface is not coplanar with the second form outer surface.

5. The corner form apparatus of claim 1, wherein, in the pour position, the linear actuator is disposed in an extended position, and further wherein, in the strip position, the linear actuator is disposed in a retracted position.

6. A corner form apparatus comprising:

(a) a body comprising:

(i) a first leg comprising at least one first elongate opening defined within the first leg;

(ii) a second leg attached to the first leg such that the body has a generally triangular cross-section, the second leg comprising at least one second elongate opening defined within the second leg; and (iii) at least two gussets disposed between and coupled to the first and second legs;

(b) a post slidably coupled to the body such that the post is slidable along an axis parallel to a longitudinal axis of the body between a first position and a second position;

(c) a linear actuator operably coupled to the body and the post, wherein the linear actuator is movable between a first actuator position corresponding with the first position of the post and a second actuator position corresponding with the second position of the post;

(d) a first movable wing moveably coupled to the first leg;

(e) a second movable wing moveably coupled to the second leg, wherein each of the first and second movable wings are movable between an extended position corresponding to the first actuator position and a retracted position corresponding to the second actuator position; and (f) at least a first set of pivot arms, wherein the first pivot arm is pivotably coupled at a first end to the post and is pivotably coupled at a second end to the first moveable wing and slidably disposed at the second end within the at least one first elongate opening, and wherein the second pivot arm is pivotably coupled at a first end to the post and is pivotably coupled at a second end to the second moveable wing and slidably disposed at the second end within the at least one second elongate opening, wherein the first set of pivot arms are movable between an extended position corresponding to the first actuator position such that the second ends of the first and second pivot arms are disposed at an outer end of the first and second at least one elongate openings and a retracted position corresponding to the second actuator position such that the second ends of the first and second pivot arms are disposed at an inner end of the first and second at least one elongate openings.

7. The corner form apparatus of claim 6, wherein the post is slidably disposed through openings defined in the at least two gussets.

8. The corner form apparatus of claim 6, wherein the second end of the first pivot arm comprises a first pin disposed within the first at least one elongate opening and the second end of the second pivot arm comprises a second pin disposed within the second at least one elongate opening.

9. The corner form apparatus of claim 8, wherein the first pin is fixedly coupled to the first moveable wing and the second pin is fixedly coupled to the second movable wing.

10. The corner form apparatus of claim 6, further comprising:

(a) a first form outer surface disposed on an outer portion of the first leg;

(b) a second form outer surface disposed on an outer portion of the second leg;

(c) a first wing outer surface disposed on an outer portion of the first wing; and (d) a second wing outer surface disposed on an outer portion of the second wing.

11. The corner form apparatus of claim 10, wherein, when the first and second wings are in the extended position, the first wing outer surface is coplanar with the first form outer surface and the second wing outer surface is coplanar with the second form outer surface.

12. The corner form apparatus of claim 10, wherein, when the first and second wings are in the retracted position, the first wing outer surface is not coplanar with the first form outer surface and the second wing outer surface is not coplanar with the second form outer surface.

13. The corner form apparatus of claim 6, wherein the first actuator position is an extended actuator position and the second actuator position is a retracted actuator position.

14. A method of forming a corner of a concrete structure, the method comprising:

attaching a corner form apparatus to adjacent concrete form panels, the corner form apparatus comprising:

(a) a rigid, angled body having a pair of leg sections and at least two gussets extending between the leg sections;

(b) a slidable post disposed within openings formed in the gussets such that the post is slidable along an axis parallel to a longitudinal axis of the body;

(c) a linear actuator mounted between the rigid, angled body and the post;

(d) a pair of extendable wings moveably coupled to the pair of leg sections, wherein a first of the pair of wings is movably coupled to a first of the pair of leg sections and a second of the pair of wings is movably coupled to a second of the pair of leg sections;

(d) a pair of pivot arms, wherein the first pivot arm is pivotably coupled at a first end to the post and is pivotably coupled at a second end to the first extendable wing and slidably disposed at the second end within a first elongate opening defined within the first of the pair of leg sections, and wherein the second pivot arm is pivotably coupled at a first end to the post and is pivotably coupled at a second end to the second extendable wing and slidably disposed at the second end within a second elongate opening defined within the second of the pair of leg sections;

configuring the corner form apparatus in a pour position, wherein the pair of pivot arms is disposed in an extended pivot arm position such that the second ends of each of the pair of pivot arms are disposed at an outer end of the first and second elongate openings, respectively, such that the pair of extendable wings are disposed in an extended wing position;

pouring concrete adjacent to the corner form apparatus;

allowing the concrete to cure;

actuating the linear actuator to move from a first position to a second position, whereby the slidable post slides from a first position to a second position, whereby the pair of pivot arms move from the extended pivot arm position to a retracted pivot arm position such that the second ends of each of the pair of pivot arms are disposed at an inner end of the first and second elongate openings, respectively, whereby the pair of extendable wings move from the extended wing position to a retracted wing position; and removing the corner form apparatus from the concrete.

15. The method of claim 14, wherein, when the pair of extendable wings are in the extended wing position, a first outer surface of a first wing of the pair of extendable wings is coplanar with a first outer surface of the first leg section and a second outer surface of a second wing of the pair of extendable wings is coplanar with a second outer surface of the second leg section.

16. The method of claim 14, wherein, when the pair of extendable wings are in the retracted wing position, a first outer surface of a first wing of the pair of extendable wings is not coplanar with a first outer surface of the first leg section and a second outer surface of a second wing of the pair of extendable wings is not coplanar with a second outer surface of the second leg section, wherein the retracted wing position facilitates removal of the corner form apparatus from the concrete.

* * * * *